United States Patent [19]

Avidan

[11] 4,229,690

[45] Oct. 21, 1980

[54] SINGLE PHASE POWER CONTROL CIRCUIT

[75] Inventor: Benjamin Avidan, Bat Yam, Israel

[73] Assignee: Techno-Instruments Ltd., Tel-Aviv, Israel

[21] Appl. No.: 892,695

[22] Filed: Apr. 3, 1978

[30] Foreign Application Priority Data

Apr. 20, 1977 [IL] Israel ..... 51917

[51] Int. Cl.[3] ..... G05F 5/00

[52] U.S. Cl. ..... 323/24

[58] Field of Search ..... 323/22 SC, 24

[56] References Cited

U.S. PATENT DOCUMENTS 3,243,689 3/1966 Perrins ..... 323/24

4,041,267 8/1977 Wechsler ..... 323/24

4,121,149 10/1978 Seltzer ..... 323/24

*Primary Examiner*—William M. Shoop

*Attorney, Agent, or Firm*—Anthony J. Casella; Michael A. Stallman

[57] ABSTRACT

A closed loop single phase continuous A.C. power control circuit for controlling the power to a load is disclosed. The circuit includes an input connectable to a source of A.C., a power level output control, a load power factor signal producing means and a power storage unit connected in parallel across the A.C. source. The power storage unit is controlled in use to provide power to the load in accordance with the setting of the power level output control and the load power factor signal.

9 Claims, 2 Drawing Figures

SINGLE PHASE POWER CONTROL CIRCUIT

Figure 1:
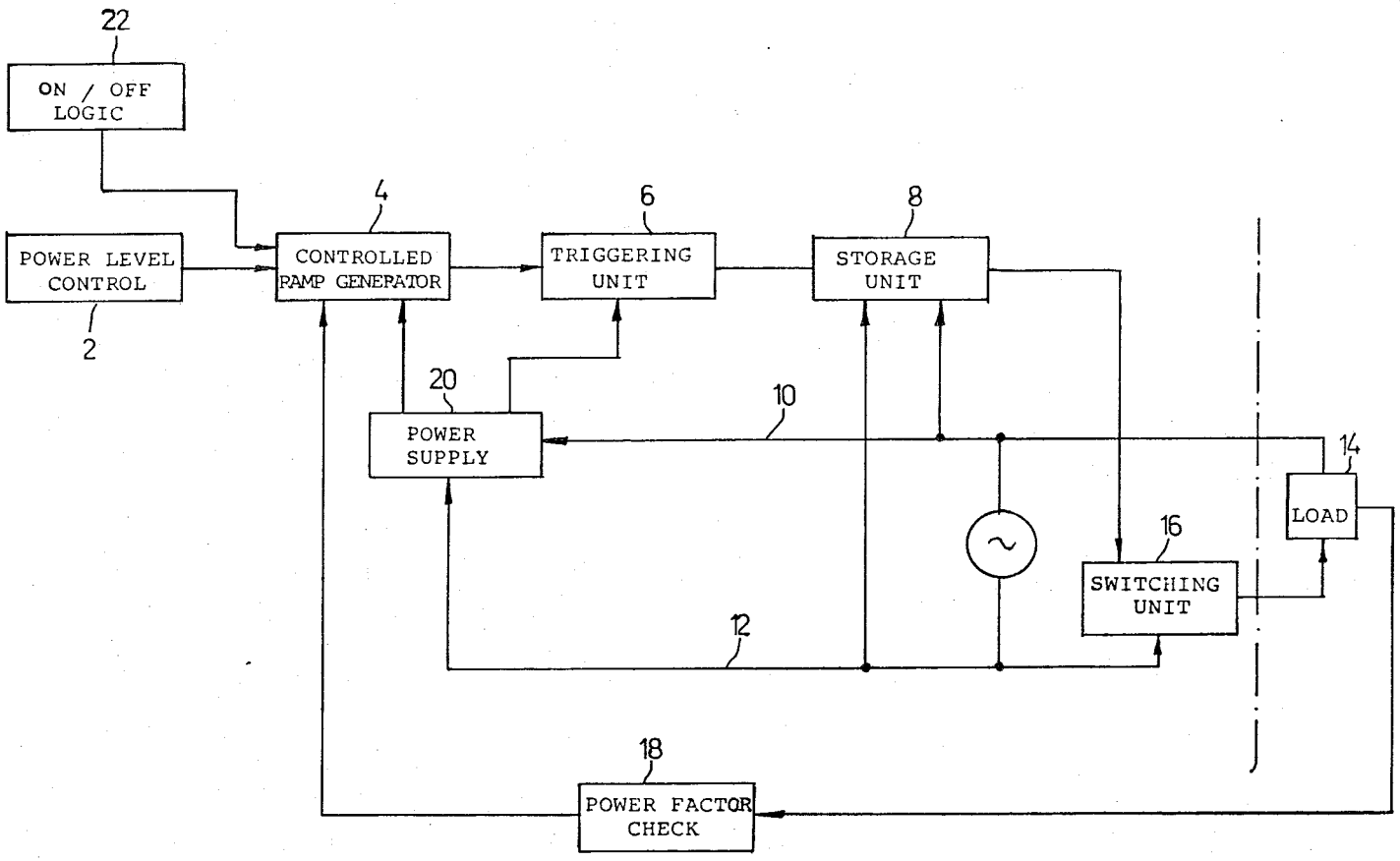

The invention relates to an electronic circuit for a power control circuit. More particularly, the present invention relates to a closed loop single phase continuous A.C. power supply circuit.

Various types of power control systems are known in the art. Notwithstanding the particular advantages and disadvantages of each specific system and its adaptability to serve a large range of loads having different power requirements, these known power systems suffer from the common inherent disadvantage of the generation of a substantial amount of heat. In addition to the fact that the generated heat represents actual wasteful power, said heat causes various adverse effects on the operation of the electronic circuit and in particular on the precision of operation and the life time of the components of the circuit.

It is therefor a broad object of the present invention to provide a power control circuit in which the internal heat generation is very small in comparison to power circuits capable of supplying similar power outputs. This feature, in turn, provides more linear and thus more precise output characteristics of the circuit as well as provides the advantage of the possibility of utilizing common electronic circuit components which do not require special heat withstanding characteristics.

In accordance with the present invention there is provided a closed loop single phase continuous A.C. power control circuit, comprising a power level output control, a load power factor signal producing means and a power storage unit connected in parallel across the mains, said power storage unit being adapted to, and controlled in use to provide power to a load in accordance with the setting of said power level output control and the load power factor signal.

By the use of the power storage unit adapted to be triggered for activation from the mains in accordance with the control signals, representing the power factor of the load and that of the power level output control, it is possible to accumulate therein the required power energy at low current during relatively long periods of time (measured in m.sec.) while the required output power is discharged therefrom and applied to the load at the proper time, during a much shorter time (measured in μsec.). It is this difference between the relatively long period of accumulation of the required energy at low current and the controlled timely release of precisely the amount of energy required by the load during a much shorter time, that results in a substantial reduction in the internal heat generation of the circuit. Since the circuit arrangement of the power control circuit according to the present invention generates only a very small amount of internal heat, e.g., only about 15% of the amount of heat of comparable power circuits, the proposed circuit is very suitable to be produced in a compactable form of small dimensions and even in a miniature form.

Furthermore, the power circuit is adapted to supply a power output to both resistive as well as inductive or capacitive loads, from a zero output to the circuit designed maximum, and optionally, is adapted to be automatically activated and deactivated by an external control factor which overrides the power level control in an ON/OFF mode.

Figure 2:
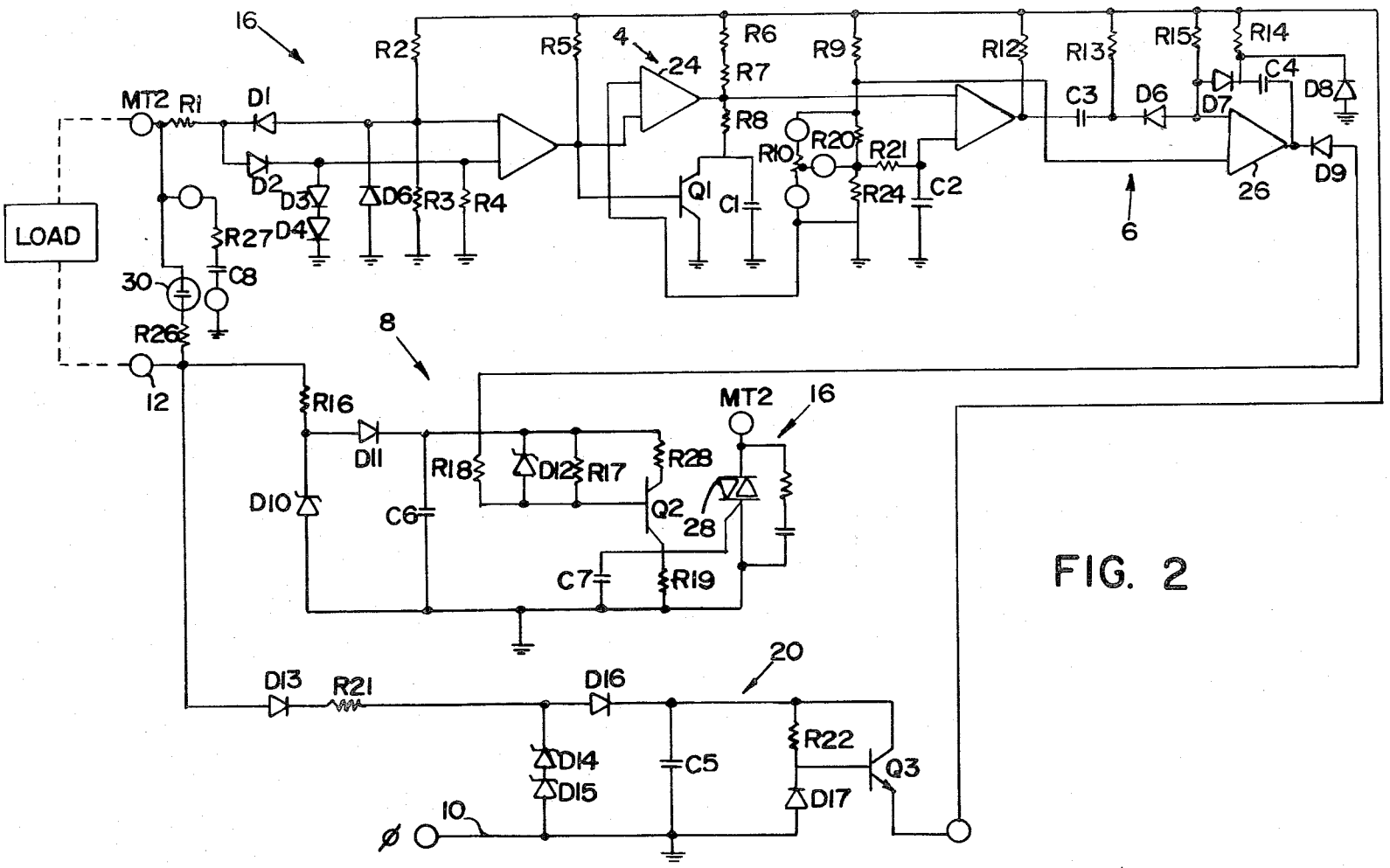

While the invention will now be described in connection with certain preferred embodiments in the following description, with reference to the accompanying drawings, it will be understood that it is not intended to limit the invention to these particular embodiments. On the contrary, it is intended to cover all alternatives, modifications and equivalent arrangements as may be included within the scope of the invention as defined by the appended claims. In the drawings:

FIG. 1 is a block diagram of the circuit arrangement of a preferred embodiment of the control circuit according to the invention; and FIG. 2 is a detailed circuit diagram of a preferred embodiment of the control circuit in accordance with the invention.

With reference first to the generalized block diagram of FIG. 1, the power circuit comprises a power level output control 2, a controlled ramp generator 4 and a power storage unit 6. The power storage unit 8 is connected in parallel across the mains 10, 12 and adapted to feed a load 14 via a switching unit 16. The load's power factor signal is constantly monitored by a power factor checking means 18 and the signal produced therein is transferred in a closed loop fashion to control the voltage ramp produced by generator 4. The required D.C. power for the circuits of the blocks is produced by the power supply 20, which in turn, is also fed by the mains 10,12.

Optionally there may be provided an ON/OFF logic circuit 22 adapted to control the activation and diactivation of the circuit in accordance with an external operational condition, e.g., temperature.

Referring now specifically to the preferred circuits of the blocks, in FIG. 2 there is shown an internal common regulated power supply consisting of capacitor C5, diodes D13, D14, D15, D16 and D17, resistors R12 and R22 and transistor Q3, suitably connected in circuit as known per-se, for providing the required D.C. potential to the control circuits including the power level output control comprising the potentiometer R10. The potentiometer R10 is connected to a voltage divider and linearization network R9, R20 and R24 and its positioning determines the control signal level at the input of the triggering unit 6. The signal is fed through a noise filter R21 and C2.

Another signal for the triggering unit originates at the controlled ramp generator R6, R7, R8 and C1. When the ramp is held in its reset state by Q1 and by operational amplifier 24, there is no output from the triggering unit.

When, however, the ramp voltage reaches the voltage level as set by potentiometer R10, a pulse is generated and is passed via the triggering unit output point which is connected to a pull-up resistor R12 to a differentiating circuit C3 and R13.

The ramp signal itself is allowed to develop in accordance with the power factor signal of the load. For example, it starts to develop when the voltage across the load has reached a preset minimum of several volts as determined by the power factor checking circuit consisting of resistors R1, R2, R3 and R4, through which the load AC signal is passed after being rectified by diodes D1 and D2. Over-voltage protecting diodes D3, D4 and D5 and a pull-up resistor R5 are also provided.

The triggering unit 6 includes a circuit arrangement consisting of C4, D6, D7, D8, D9, R14, R15 and amplifier 26. This arrangement is adapted to determine the length of the enabling pulse which is passed to the storage unit via resistor R18 for its activation from the mains.

The power storage unit is connected to the mains 10, 12 via resistor R16 and zener diode D10 which provide a rectified voltage with restrained current supply capabilities. This voltage is passed to a storage capacitor C6 through D11. The storage unit also includes a current source consisting of Q2, R17 and D12 and a limiting resistor R28. The collector of Q2 is connected to the gate of triac 28 acting as a switching unit; a resistor R19 and a capacitor C7 prevent the triggering of the switching unit by noise.

During the first half of the current cycle, transistor Q2 is nonconducting, such that the current flowing through resistor R16 and diode D11 charges capacitor C6. During the second half of the current cycle, diode D11 prevents the discharge of the capacitor C6. A pulse from triggering unit 6 which passes through resistor R8, will drop the voltage at the base of the transistor Q2 such that it becomes conductive. At this point, a current path is established between the positive plate of capacitor C6 through transistor Q2, thereby triggering the triac 28. By this arrangement, high power output is delivered to the load.

The circuit may also include an indicating lamp 30 and a protective network R27 and C8 for ensuring a non-critical dv/dt ratio when activating inductive loads.

From the forgoing description it can be understood that the only time that the power storage unit 8 is required to provide relatively high power is for the triggering of the triac 28, however, this is only for a relatively very short period, measured in μsec., while at the remaining relatively much longer period of operation during one cycle, measured in m sec., the power required for the next triac triggering is accumulated in the capacitor C6 of the storage unit at low current, thus effectively suppresing the internal heat generation of the system and keeping it at a minimum.

It will be evident to those skilled in the art that the invention is not limited to the details of the foregoing illustrative embodiments and that the present invention may be embodied in other specific forms without departing from the spirit or essential attributes thereof, and it is therefore desired that the present embodiments be considered in all respects as illustrative and not restrictive, reference being made to the appended claims, rather than to the foregoing description, in which it is intended to claim all modifications coming within the scope and spirit of the invention.

I claim:

1. A closed loop single phase continuous A.C. power control circuit for controlling the power to a load comprising an input connectable to a source of A.C., a power level output control, a load power factor signal producing means and a power storage unit connected in parallel across said A.C. source, said power storage unit being controlled in use to provide power to a load in accordance with the setting of said power level output control and the load power factor signal.

2. The circuit as claimed in claim 1 further comprising a switching means connected in said circuit between said storage unit and a load, said switching means for controlling the power transfer from said storage unit to said load in accordance with the setting of said power level output control and the load power factor signal.

3. The circuit as claimed in claim 2 wherein said switching means comprises a triac functioning as a gate.

4. The circuit as claimed in claim 1 further comprising a triggering unit for triggering said storage unit in accordance with the setting of said power level output control and the load power factor signal.

5. The circuit as claimed in claim 4 wherein the triggering unit is fed by a controlled ramp generator, said triggering unit producing a triggering signal when a voltage developed in said controlled ramp generator has reached the voltage level set by said power level control.

6. The circuit as claimed in claim 5 wherein said ramp voltage is developed in accordance with the power factor signal.

7. The circuit as claimed in claim 1 further comprising an internal regulated D.C. power supply providing the circuit with an internal control voltage.

8. The circuit as claimed in claim 1 further comprising an ON/OFF circuit means for controlling the operation of the circuit in accordance with at least one external condition.

9. The circuit as claimed in claim 8 wherein said ON/OFF circuit means functionally overrides said power level output control.

* * * * *